US007661874B2

(12) United States Patent
Conus et al.

(10) Patent No.: US 7,661,874 B2
(45) Date of Patent: Feb. 16, 2010

(54) LEVER ESCAPEMENT FOR A TIMEPIECE

(75) Inventors: Thierry Conus, Lengnau (CH); Andrés Cabezas Jurin, Yverdon-les-Bains (CH)

(73) Assignee: Omega S.A., Bienne (CH)

( * ) Notice: Subject to any disclaimer, the term of this patent is extended or adjusted under 35 U.S.C. 154(b) by 0 days.

(21) Appl. No.: 12/130,487

(22) Filed: May 30, 2008

(65) Prior Publication Data

US 2008/0298180 A1 Dec. 4, 2008

(30) Foreign Application Priority Data

May 30, 2007 (EP) ..... 07109193

(51) Int. Cl.
*G04B 15/00* (2006.01)

(52) U.S. Cl. ..... 368/131; 368/124

(58) Field of Classification Search ..... 368/127, 368/129, 124, 125, 130–132
See application file for complete search history.

(56) References Cited

FOREIGN PATENT DOCUMENTS

EP 0 018 796 B1 11/1980
EP 1 045 297 A1 10/2000

OTHER PUBLICATIONS

Daniels, G. "La Montre: Principes et Methodes de Fabrication," 1993, Editions Scriptar SA, Lausanne, pp. 247-251.
European Search Report issued in corresponding application No. EP 07 10 9193, completed Feb. 14, 2008.

*Primary Examiner*—Vit W Miska
*Assistant Examiner*—Sean Kayes
(74) *Attorney, Agent, or Firm*—Griffin & Szipl, P.C.

(57) ABSTRACT

The escapement includes an escape wheel set (1), a balance roller (3) carrying an impulse pin (4) and a first impulse pallet stone (5). It further includes a pallet assembly (8) fitted with a second impulse pallet stone (11) and first and second locking pallet stone (12, 13). The wheel set (1) includes at least one escape wheel fitted with teeth (6) that mesh directly with the teeth (20) of the first wheel of a gear train (2), the teeth (6) of the wheel (1) cooperating with the impulse pallet stones and locking pallet stones.

3 Claims, 5 Drawing Sheets

LEVER ESCAPEMENT FOR A TIMEPIECE

This application claims priority from European Patent Application No. 07109193.8, filed May 30, 2007, the entire disclosure of which is incorporated herein by reference.

FIELD OF THE INVENTION

The invention relates to a lever escapement for a timepiece, including an escape wheel set driven by a gear train, a balance roller carrying an impulse pin and provided with a first impulse pallet stone arranged for cooperating with the teeth of the wheel set and a pallet assembly articulated on a pivot and fitted with a fork cooperating with the impulse pin, the pallet assembly being provided with a second impulse pallet stone arranged for cooperating with the teeth of the wheel set and first and second locking pallet stones arranged for cooperating with the teeth of the wheel set.

BACKGROUND OF THE INVENTION

This type of escapement is known and disclosed in EP Patent No. B-18796 bearing the name of George Daniels as inventor. This escapement has several embodiments, the escape wheel set being able to be formed of a single wheel or two coaxially mounted wheels secured to each other. However, in this document, the gear train drives the wheel set via an escape pinion mounted in a conventional manner on the arbour of said wheel set and not directly via one of the wheels forming the wheel set.

In order to simplify the proposed system and especially to gain space heightwise, George Daniels developed a construction that he calls an ultra flat coaxial escapement and which he describes at pages 249 to 252 of his work "La Montre: principes et méthodes de fabrication", Scriptar Editions S.A., La Conversion, Lausanne 1993. This construction includes a wheel set formed of two coaxial escape wheels secured to each other. The first wheel cooperates with two locking pallet stones and one impulse pallet stone arranged on the balance roller applying direct impulses thereto. The second wheel cooperates with an impulse pallet stone arranged on the pallet assembly, which applies indirect impulses to the roller. This second wheel is directly driven by the teeth with which it is provided, via the last wheel set forming the gear train of the timepiece. Thus the usual aforecited escape pinion is not used here, which contributes to reducing the thickness of the escapement system. Thus, an escape wheel set is assigned the dual function of receiving the movement from the gear train and contributing to at least one of the escapement functions. With George Daniels, there is only an indirect impulse function and it is clear that any other function assigned to the wheel set, except that cited, constitutes a novelty in the field of this type of escapement.

It will also be clear that the space requirement of the escapement heightwise can be still further reduced if it has only one wheel, the latter being directly driven by the gear train.

SUMMARY OF THE INVENTION

Thus, in addition to complying with the statement of the first paragraph above, the present invention is original in that the escape wheel set includes at least one wheel and in that the teeth thereof mesh directly with the gear train.

BRIEF DESCRIPTION OF THE DRAWINGS

The invention will now be explained in detail below via several embodiments, two of which are illustrated by the drawings, these embodiments being given by way of non-limiting example and in the drawings.

DETAILED DESCRIPTION OF THE ILLUSTRATIVE EMBODIMENTS

Figure 1:
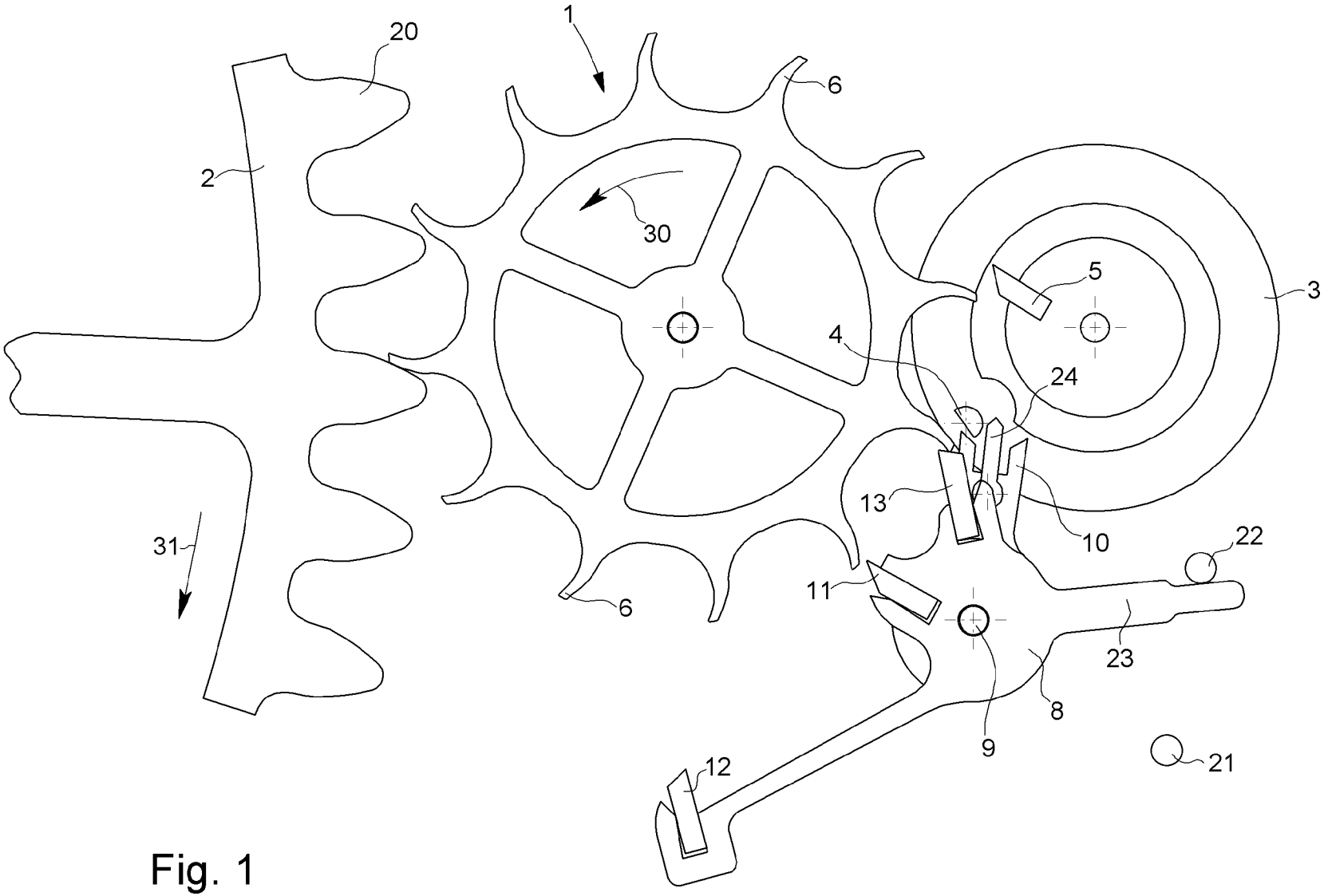
FIG. 1 is a plan view of a first embodiment wherein the escape wheel set has only one wheel.

FIG. 1 is a plan view of the escape mechanism according to a first embodiment of the invention. This escapement includes an escape wheel set 1 driven by a gear train 2 and a balance roller 3 (not shown) carrying an impulse pin 4. When it is moving, the escape wheel set 1 rotates in the direction of arrow 30, driven by gear train 2, which rotates in the direction of arrow 31.

Roller 3 is fitted with a first impulse pallet-stone 5 arranged for cooperating with the teeth 6 of wheel set 1. The escapement further includes a pallet assembly 8 articulated on a pivot 9 and fitted with a fork 10 cooperating with impulse pin 4 of roller 3. This pallet assembly is fitted with a second impulse pallet stone 11 arranged for cooperating with the teeth 6 of wheel set 1 and first and second locking pallet stones 12 and 13 arranged for cooperating with teeth 6 of wheel set 1. Fork 10 is fitted with a dart 24 which prevents pallet assembly 8 from accidentally tipping. The impulse pin 4 concerned here may be a piece made of sapphire or steel added to roller 3 as is the case in escapements of the prior art. The present invention is not, however, limited to this type of embodiment, the impulse pin could be made integral with the roller on which it is mounted, or could even form part of an element having a particular shape secured to the roller. The same is true of the various pallet-stones 5, 10, 11 and 13 used here. These may also be small sapphire parts, the last three of which are set in the arms of pallet assembly 8 and the first set in roller 3. Here too the invention is not limited to this type of embodiment. Indeed, instead of being stones, these pallets could be integral with the pallet assembly or respectively the roller.

As is shown clearly in FIG. 1, the present invention is characterized in that wheel set 1 includes at least one wheel—here a single escape wheel 1—and that the teeth 6 with which it is fitted mesh directly with gear train 2 and more specifically with the teeth 20 thereof. This gear train or going train is in fact the assembly of wheels and pinions which, transmit the drive force from the barrel to escape wheel 1. The gear train 2 illustrated here is the last wheel of the series often called the seconds wheel. In a conventional movement, this seconds wheel meshes directly with the escape pinion that does not exist in the present invention.

An escapement displaying a single wheel is illustrated at page 248 of the work of George Daniels cited above. FIG. 1 of the present invention shows that it is possible to replace the wheel of the document cited by that of the invention, with a particular configuration, such that the wheel can be driven directly by gear train 2 at the same time fulfilling all of the escapement functions, namely, cooperating with the two impulse pallet stones 5 and 11 and the two locking pallet stones 12 and 13. It will be clear that the proposed construction takes very little space heightwise and that it is economical as regards the number of parts used.

Since the operating mode of this escapement is similar to that explained hereafter with reference to the second embodiment, the reader may refer to the description below.

Figure 2:
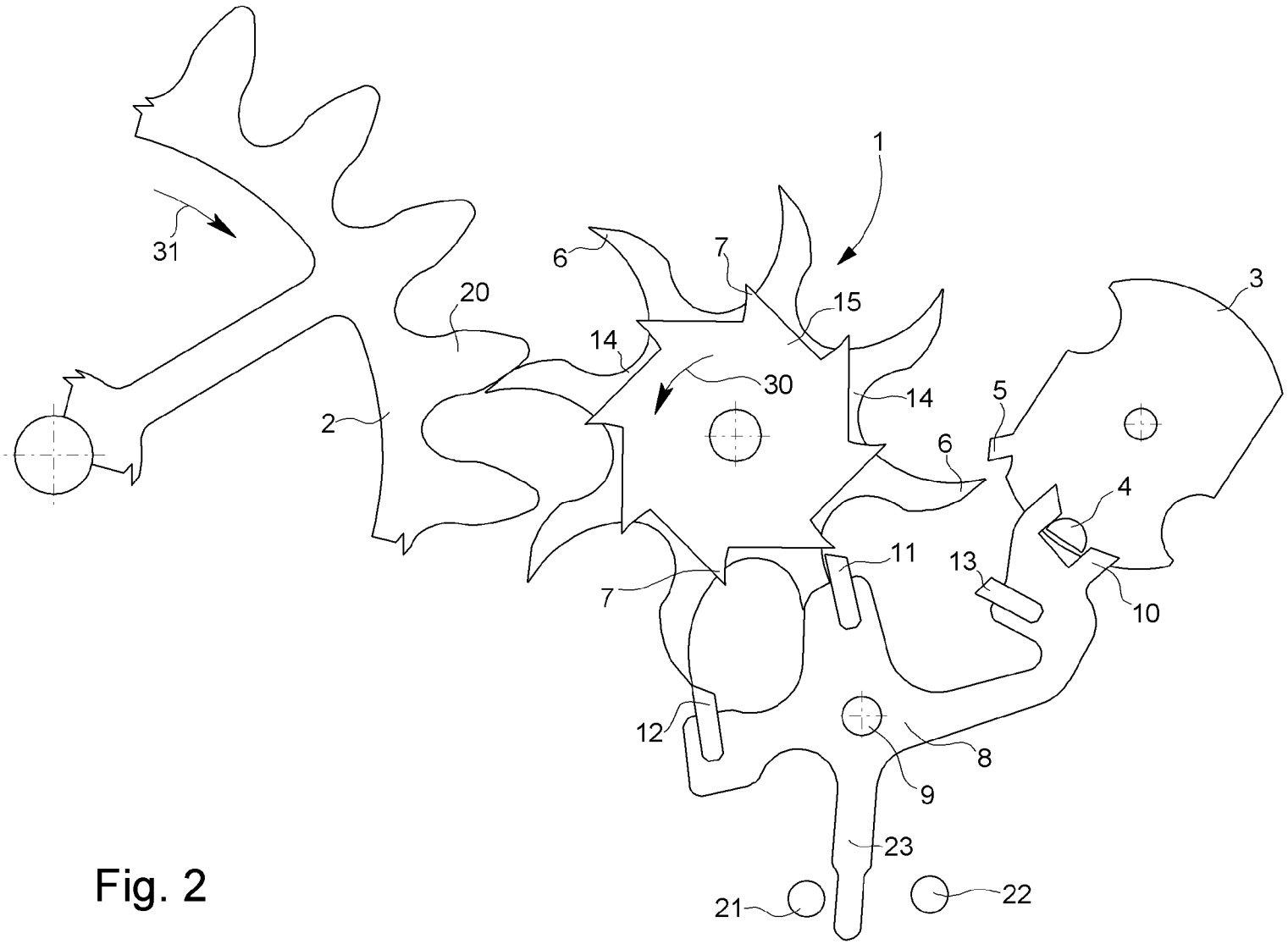
FIG. 2 is a plan view of a second embodiment wherein the escape wheel set has two coaxial wheels secured to each other.

FIG. 2 is a plan view of the escape mechanism according to a second embodiment of the invention. Here, the escape wheel set 1 includes at least first and second coaxial wheels 14 and 15 secured to each other—here two escape wheels. The teeth 6 of the first wheel 14 mesh with the teeth 20 of gear train 1, the teeth 6 of said first wheel 14 cooperating with at least one locking pallet stone 12.

More specifically, FIG. 1 shows that he first impulse pallet stone 5 and the first and second locking pallet stones 12 and 13 cooperate with teeth 6 of the first wheel 14 and that the second impulse pallet stone 11 cooperates with the teeth 7 of the second wheel 15. It will be noted that, as for the first embodiment, two pins 21 and 22 limit the travel of pallet assembly 8. The operation of this embodiment will be explained below.

Fork 10 is normally fitted with a dart like that shown with reference to the first embodiment. It has not been illustrated here in order to simplify the drawing.

It will be noted that, in this embodiment, the escape wheel that meshes with the gear train cooperates with at least one locking pallet stone. This is novel with respect to the ultra flat coaxial escape wheel proposed by George Daniels where the wheel cooperates with the impulse pallet stone implanted in the pallet assembly. This new arrangement allows several particular embodiments, in particular a third embodiment that will be briefly described now.

This third embodiment (not illustrated) is original in that the first and second impulse pallet stones 5 and 11 cooperate with the teeth 7 of the second wheel 15, the first and second locking pallet stones 12 and 13 cooperating with the teeth 6 of the first wheel 14, this first wheel also meshing with the teeth 20 of gear train 2.

The operation of the escapement according to the invention will now be described. In order to do so, we will use the second embodiment, comprising two escape wheels 14 and 15. One complete oscillation of roller 13 is illustrated in FIGS. 3 to 14 and the various operating phases will be analysed below.

Figure 3:
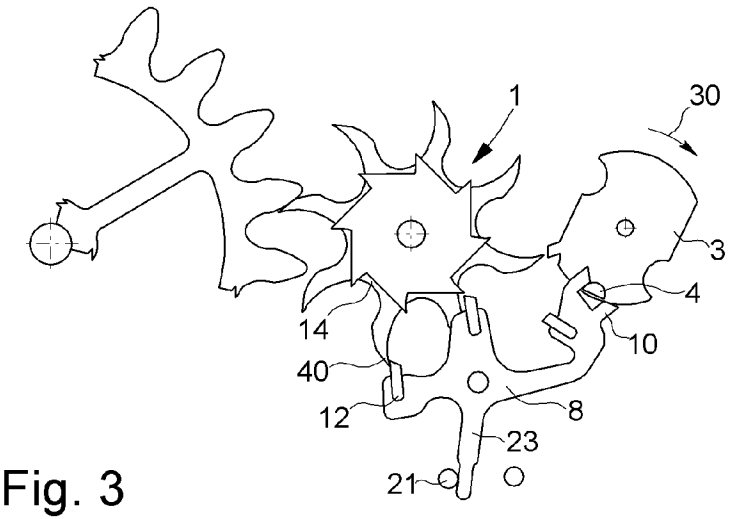

In FIG. 3, roller 3 is rotating in the direction of arrow 30. Escape wheel 1 is at rest, retained by the locking pallet stone 12, which is abutting against tooth 40 of first wheel 14. The tail 23 of pallet assembly 8 is abutting against the banking pin 21. Impulse pin 4 of roller 3 has penetrated the free space of fork 10 and has entered into contact with one tooth of the fork. This is the phase of the start of unlocking from locking pallet stone 12.

Figure 4:
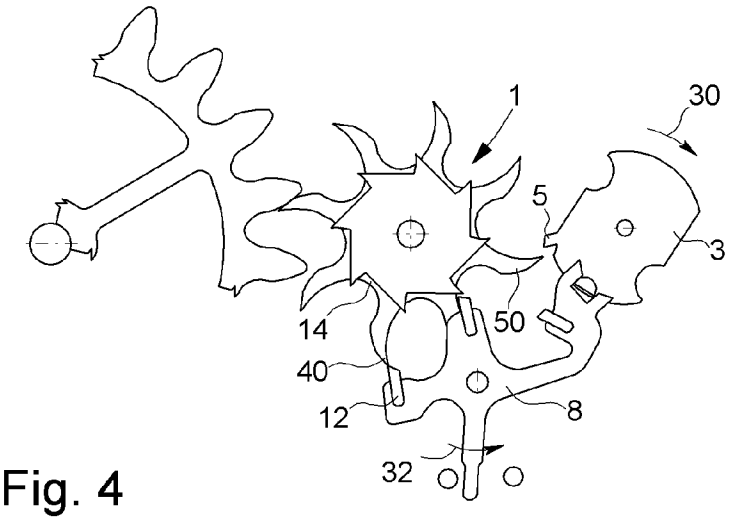
FIGS. 3 to 14 are plan views explaining the operating phases of the escapement in accordance with the second embodiment of the invention, these phases covering one complete oscillation of the balance roller.

As FIG. 4 shows, roller 3 continues to rotate in the direction of arrow 30, causing pallet assembly 8 to rotate in the direction of arrow 32. This pivoting brings locking pallet stone 12 to the end of tooth 40 of wheel 14 and releases it from the hold of that tooth. It is the unlocking phase of the escape wheel set 1. It will also be noted that while rotating, roller 3 has brought its first impulse pallet stone 5 to intersect the trajectory of tooth 50 of the first wheel 14 forming escape wheel set 1.

Figure 5:
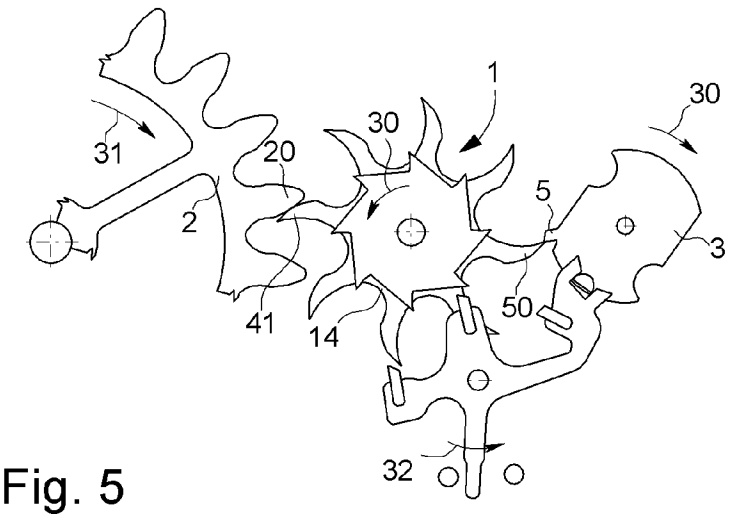

In FIG. 5, escape wheel 1 is released and rotates in the direction of arrow 30, activated by gear train 2 whose last wheel is rotating in the direction of arrow 31. The teeth of the first escape wheel 14 mesh directly with the teeth of the last wheel of gear train 2, in this case tooth 20 drives tooth 41 of wheel 14. Tooth 50 of wheel 14 has caught up with impulse pallet stone 5 secured to roller 3, and then enters into contact with the latter. This is the start of impulse phase for restarting roller 3.

Figure 6:
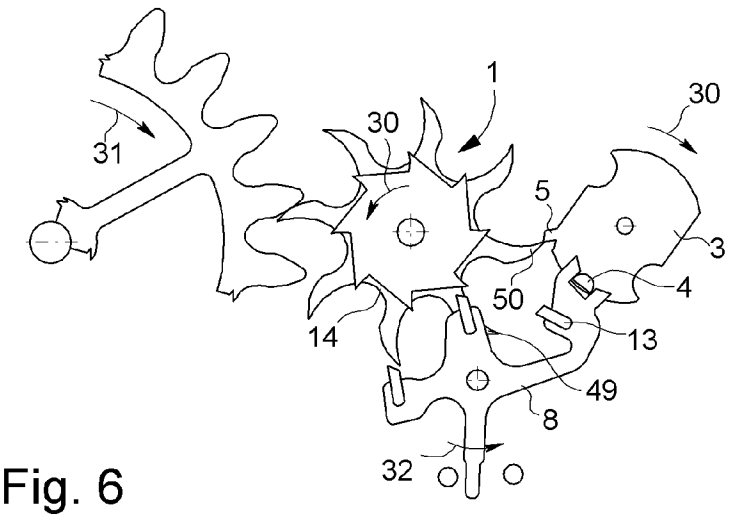

The end of impulse phase is shown in FIG. 6. Escape wheel 1, rotating in the direction of arrow 30, has brought tooth 50 of wheel 14 into the position shown in FIG. 6, i.e. on the point of letting go of impulse pallet stone 5. It will be observed that, while rotating, roller 3 has continued to drive pallet assembly 8, via impulse pin 4, in the direction of arrow 32, which has the effect of bringing the second locking face 13 to intersect the trajectory of tooth 49 of the first wheel 14 and thereby preparing the first lock.

Figure 7:
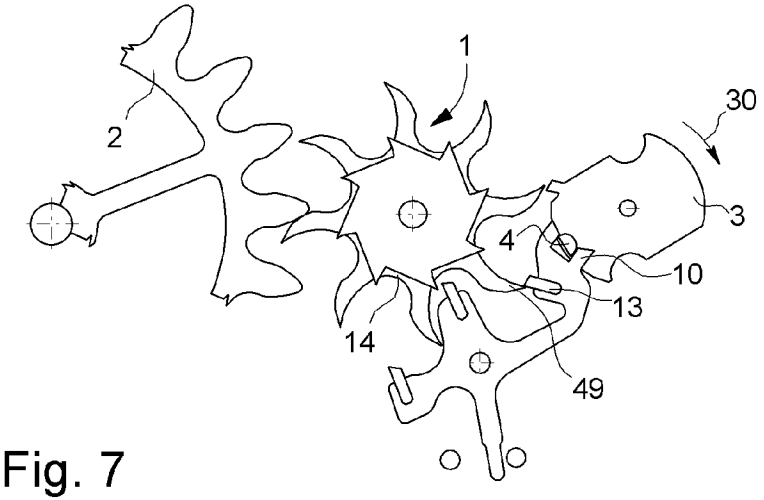

FIG. 7 shows the lock of tooth 49 of first wheel 14 on locking face 13. Roller 3 continues its rotation in the direction of arrow 30 and impulse pin 4 is on the point of leaving fork 10.

Figure 8:
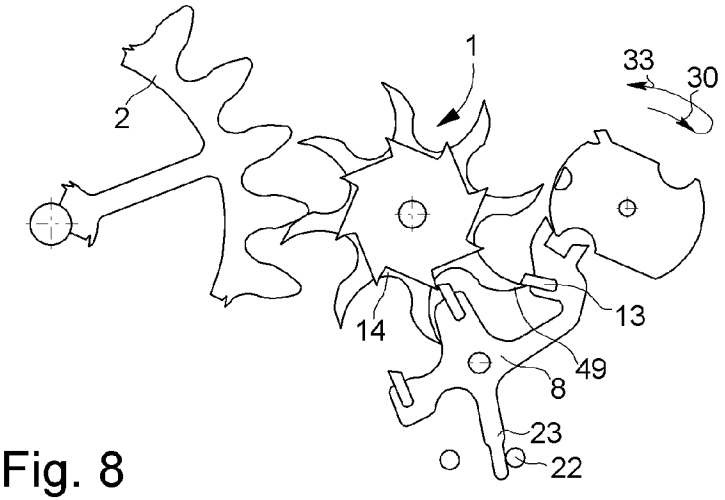

FIG. 8 shows the escapement of the invention in the total lock state. Because of the draw effect caused by the torque exerted on escape wheel set 1, locking face 13 has sunk further onto tooth 49 of first wheel 14 and tail 23 of pallet assembly 8 abuts on banking pin 22. From that moment, roller 3 travels through its supplementary arc along the direction of arrow 30 then reverses direction and retraces its steps along the direction of arrow 33. This phase marks the end of the first vibration forming the oscillation being considered.

Figure 9:
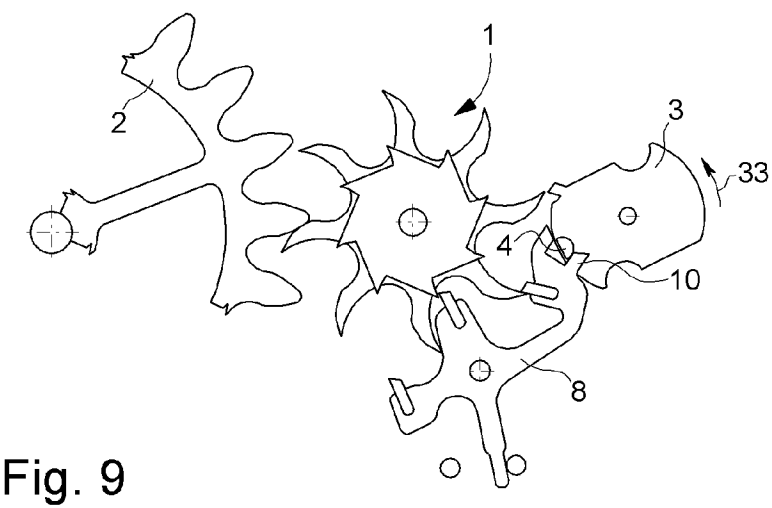

FIG. 9 shows a pallet assembly 8 in the same situation as that analysed above. Here, however, roller 3, returning in the direction of arrow 33, causes impulse pin 4 to enter into contact with fork 10 of pallet assembly 8. This is a start of unlocking phase of escape wheel 1.

Figure 10:
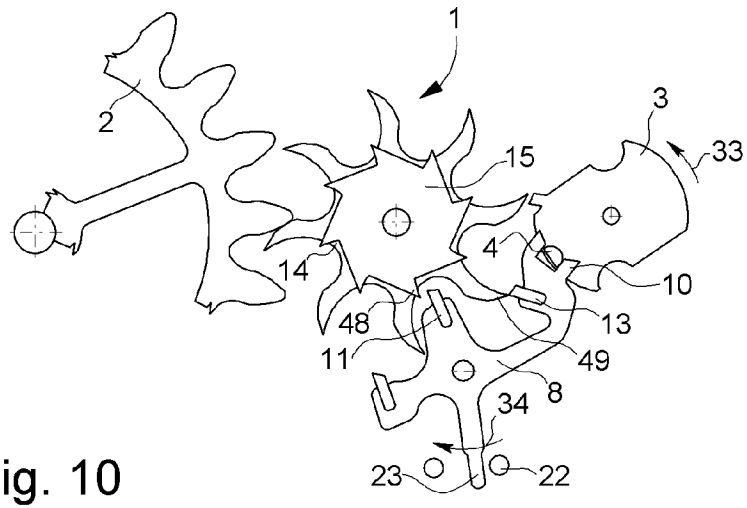

As is apparent in FIG. 10, roller 3 has continued its travel in the direction of arrow 33 and, via impulse pin 4 and fork 10, has driven pallet assembly 8 in the direction of arrow 34. The tail 23 of pallet assembly 8 has been detached from banking pin 22 and locking pallet stone 13 has been removed from the hold of tooth 49 of first wheel 14. This is a release phase of escape wheel 1. Here again, it will be noted that while rotating, roller 3 has brought the second impulse pallet stone 11 carried by pallet assembly 8 to intersect the trajectory of tooth 48 of the second escape wheel 15 forming escape wheel set 1, which thus prepares for the next impulse.

Figure 11:
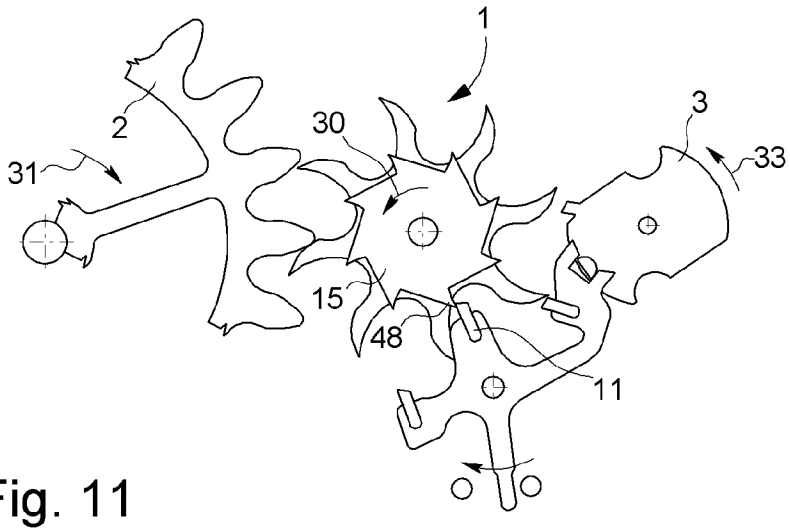

In FIG. 11, escape wheel set 1 is released and rotates in the direction of arrow 30 activated by gear train 2 as explained above. Tooth 48 of second wheel 15 has caught up with impulse pallet stone 11 then enters into contact with it. This is again a start of impulse phase for restarting roller 3.

Figure 12:
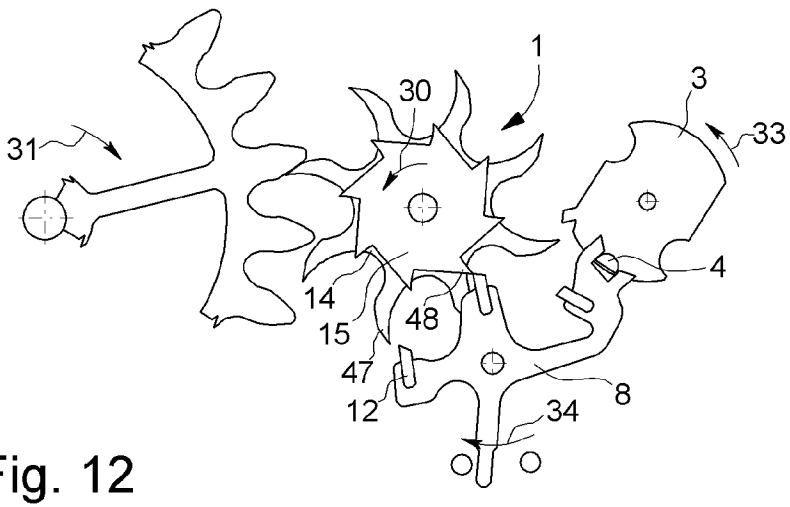

The end of impulse phase is shown in FIG. 12. Escape wheel set 1, rotating in the direction of arrow 30, has brought tooth 48 of second wheel 15 into the position illustrated in the Figure, namely on the point of letting go. It will again be observed that while rotating in the direction of arrow 33, roller 3 has continued to drive pallet assembly 8, via impulse pin 4, in the direction of arrow 34, which has the effect of bringing the first impulse pallet stone 12 to intersect the trajectory of tooth 47 of the first escape wheel 14 and thus to prepare for the next lock.

Figure 13:
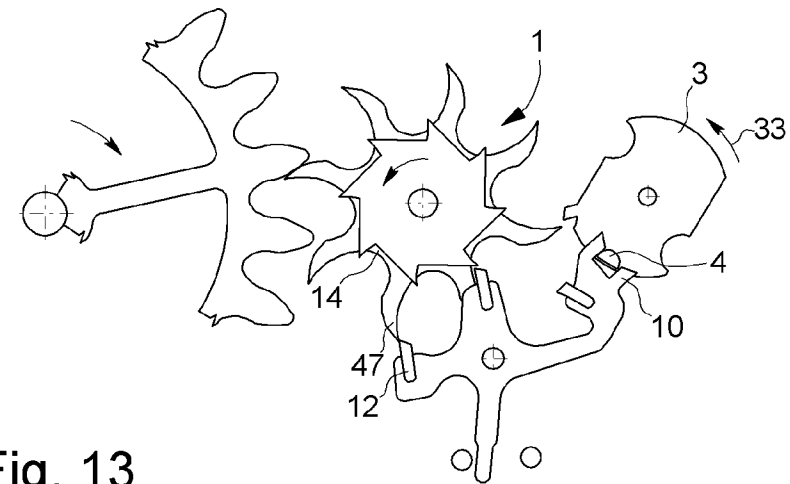

FIG. 13 shows the lock of tooth 47 of first wheel 14 on locking pallet stone 12. Roller 3 continues its rotation in the direction of arrow 3 and impulse pin 4 is on the point of leaving fork 10.

Figure 14:
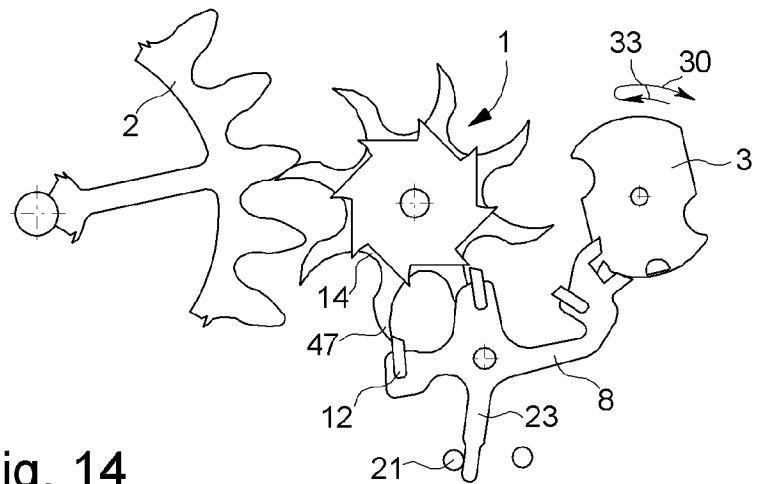

FIG. 14 shows the escapement of the invention in the total lock state. Because of the draw effect, locking pallet stone 12 has sunk further onto tooth 47 of first wheel 14 and tail 23 of pallet assembly 8 abuts on banking pin 21. From that moment, roller 3 travels through its supplementary arc along the direction of arrow 33 then reverses direction and retraces its steps along the direction of arrow 30. This phase marks the end of the second vibration forming the oscillation being considered. From this moment, a new cycle starts and we are in the starting position, i.e. that shown in FIG. 3.

What is claimed is:

1. A lever escapement for a timepiece including an escape wheel set driven by a gear train, a balance roller carrying an impulse pin and fitted with a first impulse pallet arranged for cooperating with the teeth of the wheel set and a pallet assembly articulated on a pivot and fitted with a fork cooperating with the impulse pin, said pallet assembly being fitted with a second impulse pallet arranged for cooperating with the teeth of the wheel set and first and second locking pallets arranged for cooperating with the teeth of the wheel set, wherein the escape wheel set includes at least first and second coaxial wheels secured to each other and wherein the teeth of the first wheel mesh directly with said gear train, the teeth of said first wheel cooperating with at least one locking pallet.

2. The escapement according to claim 1, wherein the first impulse pallet and the first and second locking pallets cooperate with the teeth of the first wheel and wherein the second impulse pallet cooperates with the teeth carried by the second wheel.

3. The escapement according to claim 1, wherein the first and second impulse pallets cooperate with the teeth carried by the second wheel and wherein the first and second locking pallets cooperate with the teeth carried by the first wheel.

* * * * *